US007125454B2

(12) United States Patent
Gregoire et al.

(10) Patent No.: US 7,125,454 B2
(45) Date of Patent: Oct. 24, 2006

(54) DEVICE FOR SELECTIVELY MOISTENING ENVELOPE FLAPS

(75) Inventors: Jean-Pierre Gregoire, Brie Comte Robert (FR); Alain Philippe, Saint Pathus (FR)

(73) Assignee: Neopost Industrie, Bagneux (FR)

( * ) Notice: Subject to any disclaimer, the term of this patent is extended or adjusted under 35 U.S.C. 154(b) by 0 days.

(21) Appl. No.: 10/347,400

(22) Filed: Jan. 21, 2003

(65) Prior Publication Data

US 2003/0136337 A1 Jul. 24, 2003

(30) Foreign Application Priority Data

Jan. 22, 2002 (FR) ..... 02 00740

(51) Int. Cl.
*B43M 5/04* (2006.01)
*B05B 1/28* (2006.01)

(52) U.S. Cl. ..... 118/326; 118/313; 118/323; 118/324; 156/441.5; 156/442.2; 427/421.1

(58) Field of Classification Search ..... 118/323, 118/324, 326, 300–316; 156/441.5, 442.2; 427/421

See application file for complete search history.

(56) References Cited

U.S. PATENT DOCUMENTS 3,905,325 A 9/1975 Labore et al.
3,911,862 A 10/1975 Lupkas
4,773,962 A * 9/1988 Garrigue et al. ..... 156/441.5
4,903,633 A 2/1990 Nobile et al.
4,924,805 A 5/1990 O'Dea
5,555,701 A 9/1996 Fehringer et al.
5,840,123 A * 11/1998 Holbrook ..... 118/603
5,976,313 A * 11/1999 Maguire, III ..... 156/441.5
6,193,825 B1 * 2/2001 Dolan ..... 156/64
6,206,586 B1 * 3/2001 Wen et al. ..... 396/604
6,341,840 B1 * 1/2002 van Doorn et al. ..... 347/41

* cited by examiner

*Primary Examiner*—Linda Gray
*Assistant Examiner*—Kimberly K McClelland
(74) *Attorney, Agent, or Firm*—Sughrue Mion, PLLC

(57) ABSTRACT

This invention relates to a device for moistening envelope flaps, comprising a reservoir of liquid, means for pumping this liquid and, disposed transversely with respect to a direction of advance of the envelopes and inclined with respect to a horizontal plane for supporting these envelopes, means for spraying on the envelope flaps a part of the liquid pumped from the reservoir of liquid. This inclination of the spray means corresponds to the angle of inclination of the flaps of envelopes with folded down flaps.

8 Claims, 3 Drawing Sheets

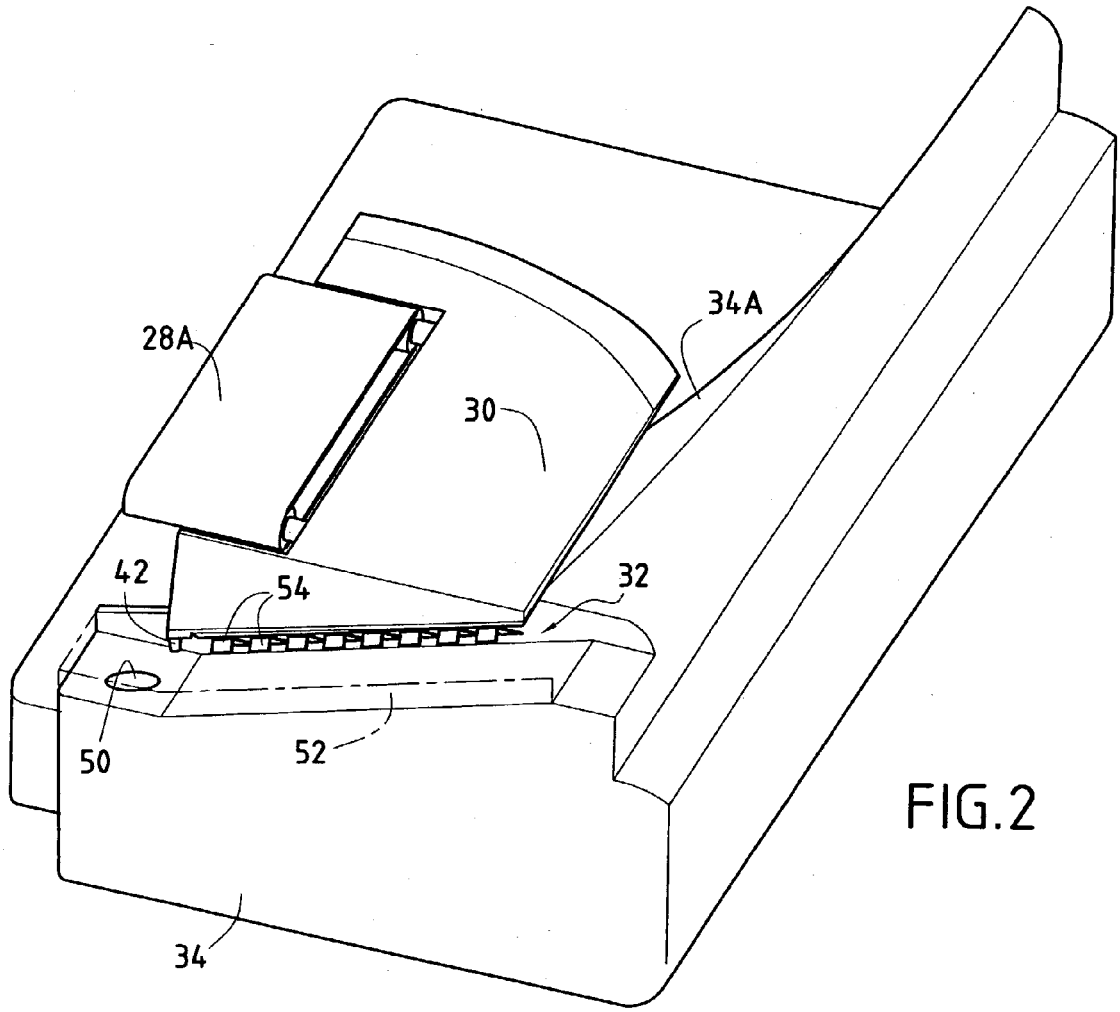
FIG.2
FIG.3
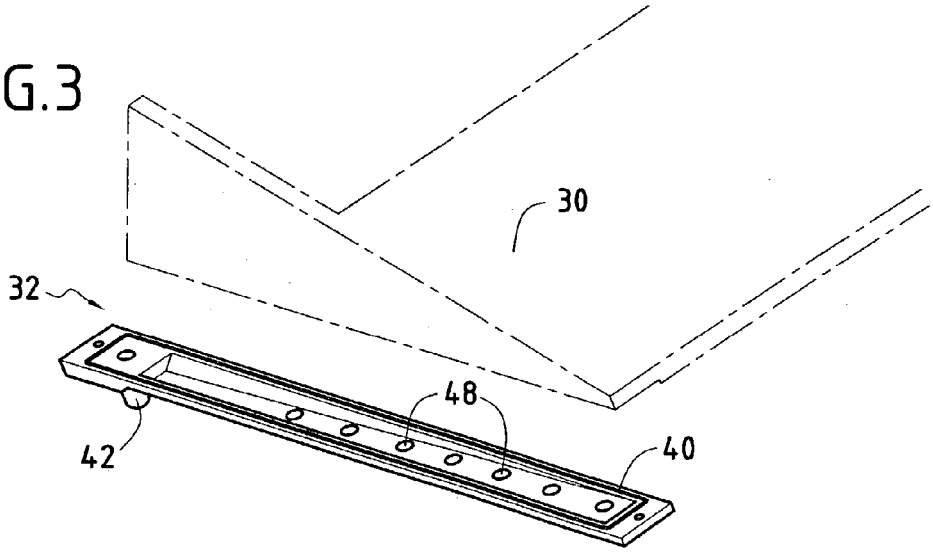

DEVICE FOR SELECTIVELY MOISTENING ENVELOPE FLAPS

FIELD OF THE INVENTION

The present invention relates exclusively to the domain of mail handling and more particularly to a device for moistening the flaps of envelopes, integrated in a mail handling machine and presenting a considerable versatility of use.

BACKGROUND OF THE INVENTION

Envelope moistening devices are well known. U.S. Pat. No. 4,903,633 illustrates an example thereof, with, disposed from upstream to downstream with respect to the direction of advance of the envelopes, a separator for separating the flap from the body of the envelope and a moisture applicator, placed just behind this separator, for moistening this flap once this flap is separated from the body of the envelope. This moisture applicator is preferably formed in two parts, with an applicator element whose end rests on a pad partly immersed in a reservoir of water disposed beneath the conveyor table, the flap being moistened during its passage between the applicator element and this moistened pad.

However, this moistening device suffers from several limitations due in particular to its moistening member. Firstly, its dimensioning prevents the passage of envelopes whose flaps exceed the width of the moistening member proper, conventionally of the order of 4 or 5 cm. Secondly, the nature of its material, composed of bristles and cellular material, is particularly subject to wear and tear and obliges regular changes, otherwise moistening is partial and non-homogeneous. Finally, without a complementary masking element for example, the very arrangement of the moistening member does not allow the passage of envelopes with open flaps without necessarily moistening the flaps thereof.

It is therefore an object of the present invention to provide a moistening device capable of moistening envelopes of different formats and types. The invention proposes producing such a device simply and inexpensively, minimizing the modifications to be made to a standard mail handling machine.

SUMMARY OF THE INVENTION

These objects are attained by a device for moistening envelope flaps, comprising a reservoir of liquid and means for pumping this liquid, characterized in that it further comprises, disposed transversely with respect to a direction of advance of the envelopes and inclined with respect to a horizontal plane supporting these envelopes, means for spraying on the envelope flaps part of the liquid pumped from the reservoir of liquid.

In this way, with this particular configuration, it is a simple matter to handle all types and formats of envelopes. In addition, it becomes possible to handle envelopes with half-open flaps without moistening the latter.

Said inclination of the spray means corresponds to an angle of inclination of the flaps of envelopes with folded down flaps, viz. an inclination included between 10 and 20°, and preferably 15°.

This inclined configuration of the spray means allows the passage of flaps of very-large width, i.e. up to 9 cm, and this without noteworthy-modification of the architecture of the mail handling machine.

The spray means preferably comprise a bar perforated with the orifices from which are sprayed droplets of liquid, these orifices advantageously being disposed in a single line of projection.

According to an advantageous form of embodiment, the reservoir of liquid comprises an opening for collecting the excess liquid sprayed through the orifices of the bar and channeled by a recovery gutter and its upper surface constitutes a fixed deflection means for assisting guiding of the flaps of the nested envelopes. This upper surface of the reservoir of liquid advantageously comprises a plurality of spring blades for applying the flaps of envelopes which are nested or with folded down flaps, against the bar.

BRIEF DESCRIPTION OF THE DRAWINGS

The invention will be more readily understood on reading the following description given by way of non-limiting example and with reference to the accompanying drawing, in which:

FIGS. 1 and 2 are views in longitudinal section and in partial perspective respectively, of a module for feeding mail items, showing a moistening device according to the invention.

FIG. 3 shows the spray means of the moistening device of FIGS. 1 and 2.

DESCRIPTION OF PREFERRED EMBODIMENT

Figure 4:
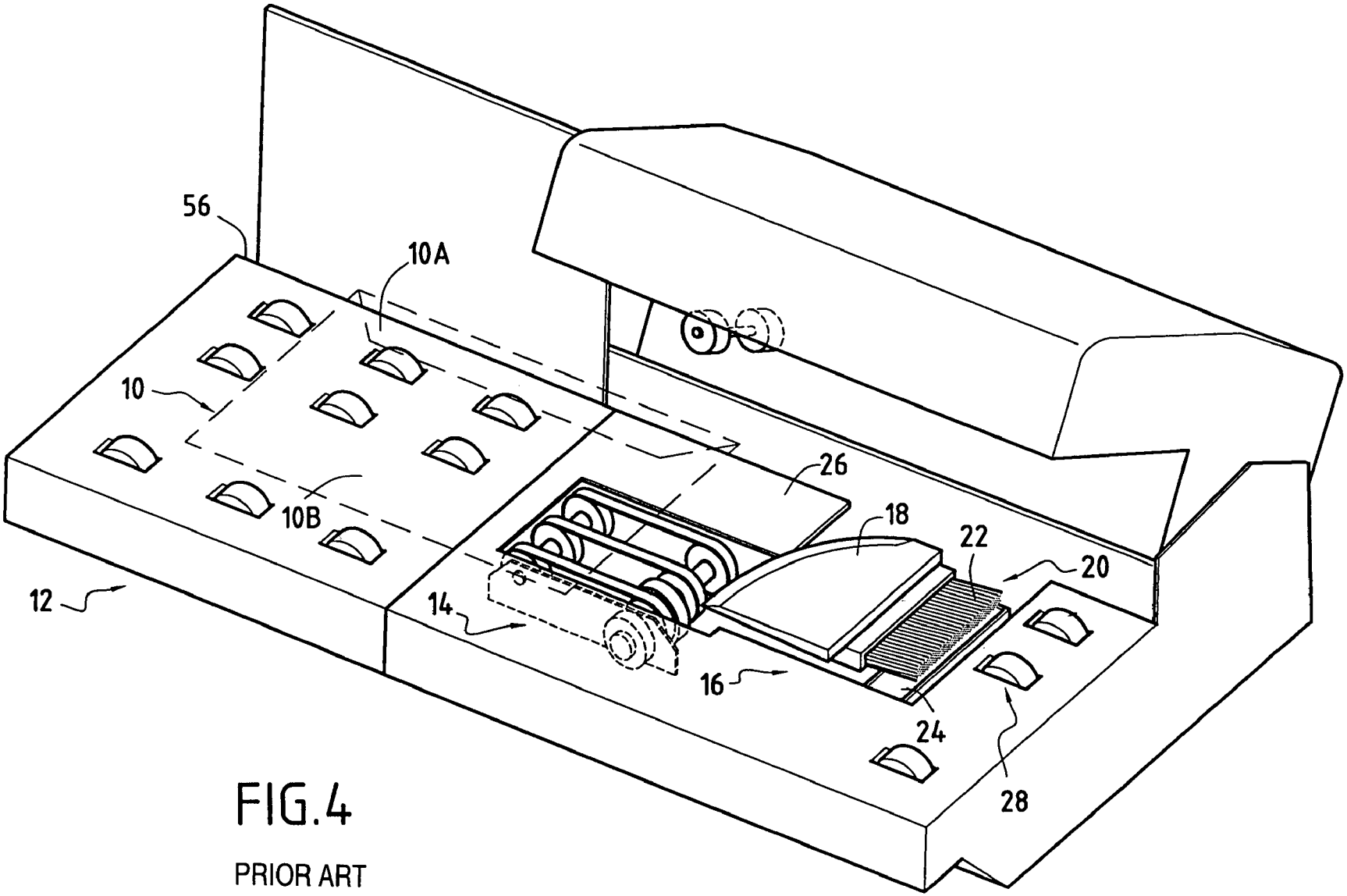
FIG. 4 PRIOR ART
FIG. 4 is a simplified view in perspective of a mail item feed module comprising a moistening device of the prior art.

Referring now to the drawings, FIG. 4 is a view in perspective of a conventional mail item feed module intended to be arranged at the entrance of a franking machine. Such a module may of course also be directly integrated in this machine. The mail items 10 that may be handled by this module are preferably envelopes with open flaps (also called nested), folded down flaps (i.e. half-open) or closed flaps. However, it may also be question of simple documents (for example in format A4) on which postal indicia will then be directly printed.

This feed module comprises, in addition to its usual zones of reception of documents 12 and of selection 14 (only partially shown), a conventional moistening device 16 formed successively (i.e. from upstream to downstream with respect to the direction of advance of the mail items) by a separator 18 for separating the flap of the envelope 10A from the body of the envelope 10B and a moistener 20, placed just behind this separator, for moistening this flap once the flap 10A is separated from the body of the envelope 10B. This moistener is preferably formed by a brush 22 of which the end rests on the surface of a small basin of water 24 arranged beneath a table 26 for supporting the mail items, a flap in that case being moistened during its passage between the brush and the basin of which constant-level feed is effected from a reservoir or a container of water (not shown). Drive means 28 are in addition conventionally disposed at the outlet of the moistener 20 to convey the mail items up to the inlet of the franking machine or of the following module of the mail handling machine, in principle a module (not shown) for printing postal indicia, when the feed module is directly integrated in this machine. In general, the inlet rollers of the printing module act as means for closing the previously moistened envelopes, unless the feed module presents its own closure means.

Figure 1:
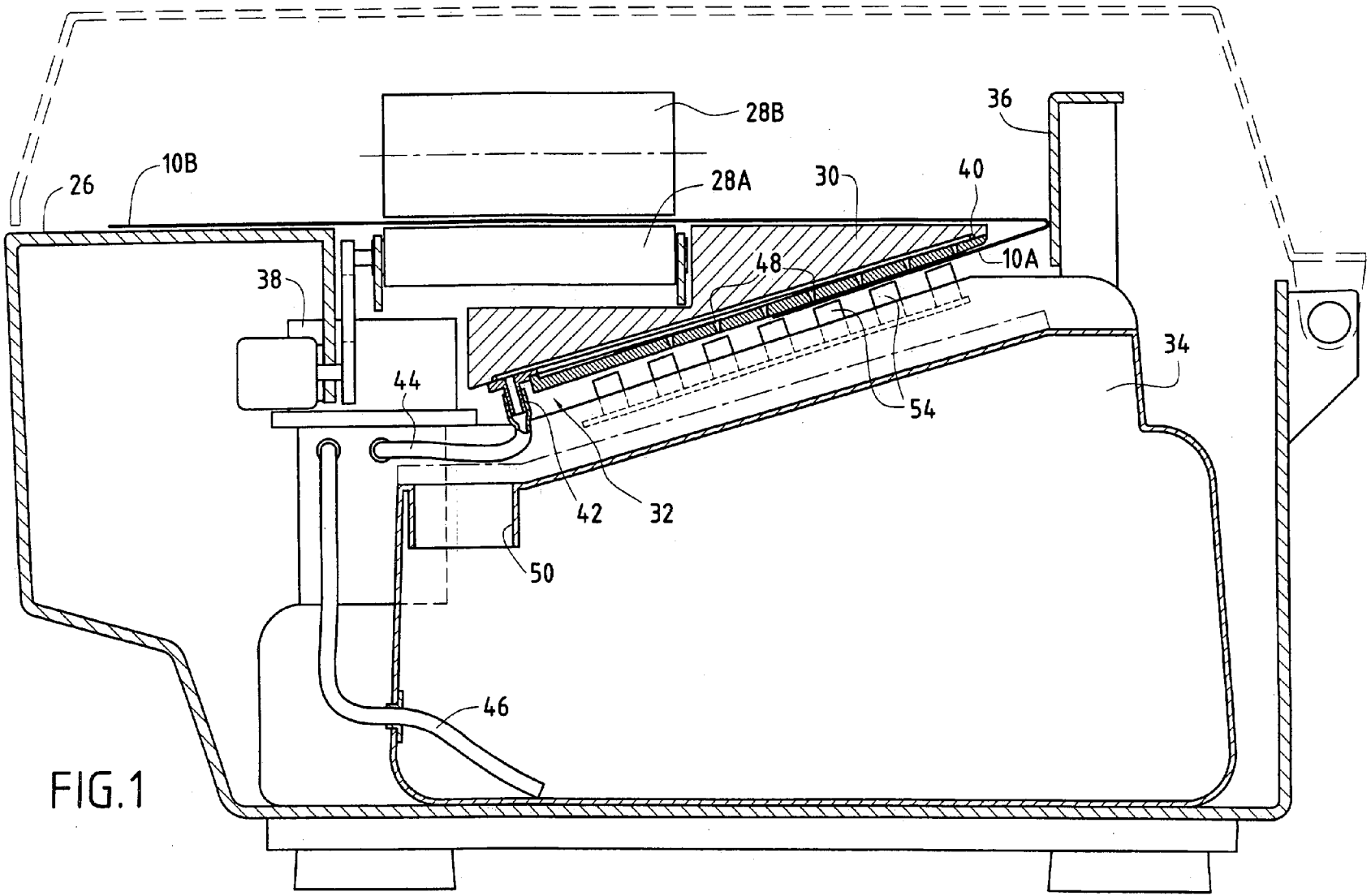

FIGS. 1 and 2 respectively show in transverse section and in partial perspective, a device according to the invention for moistening envelope flaps, which may be employed in a feed module-of the type of FIG. 4 instead of the conventional moistening device illustrated. This moistening device, integrated in a mail handling machine, is also composed of a separator 30 and a moistener 32 associated with a reservoir of liquid 34 and with the conventional wall 36 for aligning the envelopes. However, the means for driving the mail items (belt 28A and roller 28B) are maintained disposed directly at the level of the separator.

According to the invention, the moistener of this moistening device is constituted by means for spraying onto the envelope flaps 10A a humidifying liquid, preferably water, pumped by pumping means 38 from the reservoir of liquid 34. These spray means are disposed transversely with respect to the direction of advance of the envelopes and inclined with respect to the horizontal plane supporting the envelopes 26. This inclination of the spray means included between 10 and 20°, preferably 15°, which corresponds to the inclination of the lower surface of the separator 30 (which defines the angle of inclination of the folded-down flaps) allows in addition the moistening of large-dimensioned flaps, typically up to 9 cm in width, contrary to the conventional horizontal moistening members limited to a width of 4 to 5 cm. In addition, the inclined arrangement of the spray means makes it possible, when the pumping means 38 are stopped, to promote delivery of the liquid by gravity towards these pumping means and therefore the passage through the moistener of envelopes with open or half-open flaps without the risk of moistening the flaps of these envelopes.

As illustrated in FIG. 3, these spray means 32 are formed by a perforated bar fixed (by any conventional fixing means which have not been shown) on the inclined lower surface of the separator 30, sealing means (a bead joint 40 for example) being provided between this bar and the separator. The liquid is introduced in this bar at its lowermost end by a connector 42 connected to the pumping means by a first elastic conduit 44 (the pumping means 38 themselves being connected to the reservoir 34 by a second conduit 46), and sprayed in the form of droplets on the envelope flaps via a plurality of orifices 48 pierced perpendicularly in this bar and disposed regularly, preferably along one line of projection.

Taking into account the dimensions of the envelope flaps which vary depending on the format of the envelopes, it so happens that the projection of the droplets, particularly through the lowermost orifices and therefore those most remote from the wall 36 for aligning the envelopes, does not occur on the flaps but outside them. There is thus provided at the level of the liquid reservoir 34 an opening 50 for recovering this liquid projected in the void, this excess liquid advantageously being channeled towards this opening thanks to a gutter 52 (shown in dotted lines) mounted on the edge of the reservoir all along the perforated bar.

In order to ensure a perfect contact of the flaps with the spray means and thus guarantee a uniform humidification of these flaps, it is preferably provided to use a plurality of spring plates 54 arranged in the path of travel of the mail items at the downstream part of the reservoir substantially level with the spray means. These supple plates 54, by applying the flaps against the bar, will assist maintenance of this contact without braking the advance of the envelope.

It will be noted that, in the configuration illustrated, the reservoir of liquid 34 is advantageously arranged entirely beneath the surface supporting the mail items 26, its upper surface being used as surface for guiding the envelope flaps and more particularly shaped as fixed deflection means (in the form of delta wing 34A) for nested envelopes, with an initial position of the flaps about 90° (these flaps in that case being in a groove (reference 56 in FIG. 4) against the aligning wall 36) and a final position corresponding to the inclination of the spray means, viz. an inclination included between 10 and 20°, preferably 15°.

This reservoir may, of course, also have a more conventional rectangular shape, the fixed deflection means in that case being mounted directly on the aligning wall. Depending on the size of this reservoir, an additional exchangeable or refillable liquid container, currently containing 1.5 litre, may also be associated with this reservoir in order to increase the capacity and facilitate the periodic filling thereof.

What is claimed is:

1. Device for moistening envelope flaps, comprising;

a reservoir of liquid;

a pump for pumping this liquid;

a separator for respectively separating the envelope flaps from bodies of the envelopes;

a bar perforated by orifices from which droplets of liquid pumped from the reservoir are sprayed onto the envelope flap, said bar extending from said separator transversely with respect to a direction of advance of the envelopes and inclined with respect to a horizontal plane supporting the envelopes; and a seal provided at a junction between said separator and said perforated bar, wherein said inclination of the perforated bar corresponds to an angle of inclination of the flaps of envelopes with folded down flaps, and wherein said reservoir of liquid comprises an opening for collecting the liquid sprayed in excess through the orifices of the bar and channelled by a recovery gutter.

2. The moistening device of claim 1, wherein said inclination of the perforated bar is included between 10 and 20°.

3. The moistening device of claim 1, wherein said reservoir of liquid comprises an upper surface which also constitutes a fixed deflection means for assisting guiding of the flaps of nested envelopes.

4. The moistening device of claim 3, wherein said upper surface of the reservoir of liquid comprises in its downstream terminal part an inclined surface having an inclination included between 10 and 20°.

5. The moistening device of claim 3, wherein said upper surface of the reservoir of liquid comprises a plurality of spring blades for assisting application of the flaps of nested envelopes or folded down flaps, against the bar.

6. The moistening device of claim 1, wherein it is integrated in a mail handling machine.

7. The moistening device of claim 1, wherein said inclination of the perforated bar is 15°.

8. The moistening device of claim 3, wherein said upper surface of the reservoir of liquid comprises in its downstream terminal part an inclined surface having an inclination of 15°.

* * * * *